United States Patent [19]

Dobry et al.

[11] Patent Number: 5,052,499

[45] Date of Patent: Oct. 1, 1991

[54] PNEUMATIC IMPACT TOOL

[75] Inventors: Marian W. Dobry; Czeslaw Cempel; Wieslaw Garbatowski, all of Poznan, Poland

[73] Assignee: Politechnika Pozanska, Poznan, Poland

[21] Appl. No.: 325,302

[22] Filed: Mar. 16, 1989

[30] Foreign Application Priority Data

Mar. 29, 1988 [PL] Poland ..... 271527

[51] Int. Cl.[5] ..... B25D 17/11

[52] U.S. Cl. ..... 173/162.1; 173/139

[58] Field of Search ..... 173/162.1, 162.2, 131, 173/139, 133

[56] References Cited

U.S. PATENT DOCUMENTS

| | | | |
|---|---|---|---|
| 3,640,351 | 2/1972 | Coyne et al. | 173/133 X |
| 4,327,807 | 5/1982 | Emonet | 173/162.1 |
| 4,366,870 | 1/1983 | Frederick | 173/131 |
| 4,402,369 | 9/1983 | Nikita et al. | 173/162.1 |

FOREIGN PATENT DOCUMENTS

| | | |
|---|---|---|
| 115085 | 7/1982 | Poland . |
| 118242 | 4/1983 | Poland . |
| 121231 | 10/1983 | Poland . |
| 122381 | 6/1984 | Poland . |
| 128491 | 8/1985 | Poland . |
| 122477 | 12/1985 | Poland . |

*Primary Examiner*—Joseph M. Gorski
*Assistant Examiner*—Willmon Fridie, Jr.
*Attorney, Agent, or Firm*—Ladas & Parry

[57] ABSTRACT

The pneumatic impact tool is characterized by that the working tool /1/ has a flange that protect the tool from falling out and rests on the thrust ring /2/ mounted in the barrel seat as the hammer tool is being pressed down; moreover one of the noise suppressor chambers that is made up of the conic sleeve /34/ so pushed on the body-casing /4/ as that could rotate round axis, is connected with the second chamber that is made up of the space between the body-casing /4/ and the pneumatic motor's body by means of orifices opened at angle acute to the main axis of the tool symmetry and at tangent to the body plane of the pneumatic motor that is connected with the vibro-isolator of constant reaction force, by means of the vibro-isolating spacers /14/ and temporary fastening /16/, and at the same time the indirect sleeve /25/ mounted between the feeder's pipe /24/ and the barrel head and the elastic layer /38/ act as an additional vibro-isolation between the body-casing /4/ and the grip /23/ and moreover the space before the feeder's pipe /24/ is connected in the indirect sleeve /25/ with the first chamber of the air decompressor by mean of the air passages /32/.

11 Claims, 1 Drawing Sheet

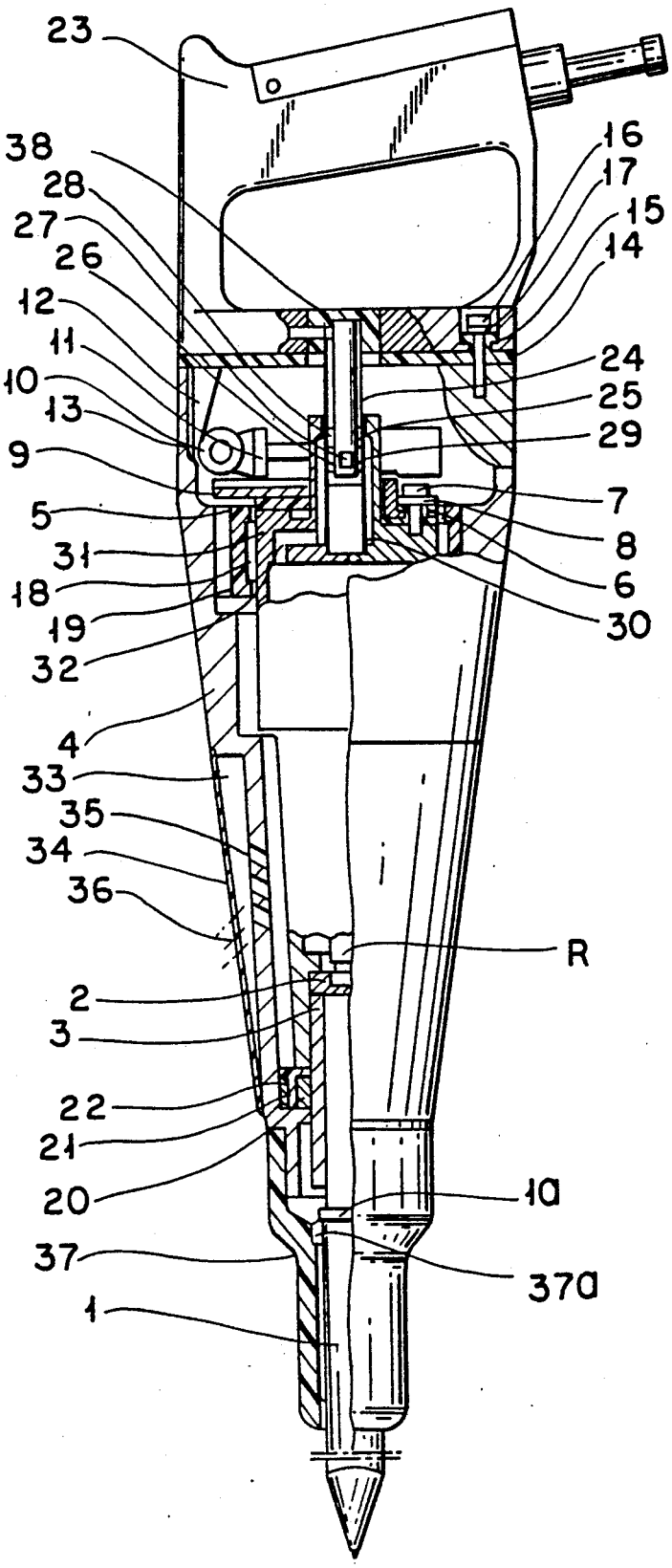
23
38
28
27
26
12
11
10
13
9
5
31
18
19
32
4
33
35
34
36
2
3
22
21
20
37
1
16
17
15
14
24
25
29
7
8
6
30
R
10
37a

PNEUMATIC IMPACT TOOL

BACKGROUND OF THE INVENTION

The subject of the invention is a pneumatic impact tool designed particularly for cleaning castings in foundries.

There is known a pneumatic hammer, as per Polish patent specification No: 128491, fitted with a casing inside of which is mounted a working cylinder in the form of a pipe and fitted with a ram which moves in the sleeve along its axis. This hammer is also fitted with a sealing sleeve fixed in the hammer casing on level with the air inlets that open into the working cylinder. The sleeve closes the air inlets when the working cylinder is at its rest point.

The design shown in this patent doesn't provide a sufficient degree of vibroisolation to comply with vibration standards in force.

The pneumatic hammer as per Polish patent specification No: 122477 has the same disadvantages.

Another hammer design is shown in Polish patent specification No: 122381. This hammer includes a vibroisolator with a negative elastic compensation having a narrow performance range of vibro-isolation. Thus, it cannot be miniaturized as would be required for use within hand-held tools.

There are known other designs of pneumatic hammer tools with reaction damping and fitted with force transformers, as per Polish patent specifications No: 115085 and No: 118242. In these designs, the mass of the tool body acts as a transforming mass, i.e., as a force transformer. The body is divided into two working chambers: one of them—a ram chamber, the other one—a piston rod chamber. The piston rod chamber is under permanent air pressure. Air is led to the ram's working chamber through two passages: one of them being between the ram and the working tool, the other one—between the piston rod and the ram.

The air distribution and feeding of each chamber with air as per the above-mentioned patent is very difficult to realize in production processes. The necessary synchronization of movements of all the masses is disturbed by the striker and the material being worked on that irregularly affects the hammer's casing. Moreover, the need for an additional transformer and chambers precludes the hammer from being shorter.

SUMMARY OF THE INVENTION

The pneumatic (impact) tool as per this invention includes a pneumatic motor, the casing of which is separated from the tool body-casing by means of a vibro-isolating system, an air supply system, a double-chamber noise suppressor, and a working tool which is slidably connected within a tool sleeve.

The essence of one aspect of the invention is that the working tool has a flange to prevent the tool from falling out and the working tool rests on a thrust ring that is mounted in the bottom of a barrel seat while the tool is being pressed down at the beginning of working with the tool. Moreover, according to another aspect of the invention, noise suppression means for the tool comprises a second noise suppressor chamber that is formed by a conic-shaped sleeve bushed onto the body-casing and rotatable therearound, which second chamber is connected with a first chamber comprising a space between the body casing and the body of the pneumatic motor. The connection between the two chambers is made by means of orifices disposed at an acute angle with respect to a plane perpendicular to the main symmetry axis of the hammer tool. The body of the pneumatic motor is connected with a constant interaction force vibro-isolator by means of vibro-isolating spacers and removable fastening means. Also, the air supply system comprises a discontinuous feed line disposed between an air supply feeder and the pneumatic motor. An elastic sleeve provides an additional vibro-isolation between the body-casing and the grip.

As described hereinafter, the compressed air supply system of the invention suppresses variable uplift pressures resulting from air pressure fluctuations and the attendant undesirable vibrations present in other tools.

Moreover, a double-chamber noise suppressor is provided including means whereby the operator is able to set the direction of the air out-flow.

DESCRIPTION OF THE DRAWING

A pneumatic hammer tool in accordance with the invention is shown in the single figure which is a vertical-section along the tool's symmetry axis.

DESCRIPTION OF PREFERRED EMBODIMENT

The pneumatic impact tool is composed of a pneumatic motor, which is separated from the tool body-casing by means of a vibro-isolating system, an air supply system, a double-chamber noise suppressor, and a working tool which is slidably connected within a tool sleeve.

The pneumatic motor is made up of a ram R moving to-and-fro in a barrel that, within its upper end, has (not illustrated) a distributor slider body in which an air distribution slider moves. The distribution slider body is pressed against the barrel face by a barrel head 31 that is screwed onto the barrel and fastened by a pin and ring. The lower end of the barrel is made up of a tool sleeve 3 pressed within a downwardly extending barrel seat. In the bottom (looking upwardly) of the barrel seat is mounted a thrust ring 2. The working tool 1 moves in the tool sleeve 3 and rests on the thrust ring 2 as the hammer tool is being pressed down against material to be worked out. As shown in the drawing, when the working tool 1 is pressed against the thrust ring 2, the ram R is in contact with the upper end of the tool 1. When the ram R moves upwardly into the barrel, the tool 1 remains pressed against the thrust ring 2 by the engagement of its lower end with the object being worked on.

To prevent the tool 1 from falling out of the barrel when the tool is not engaged with a workpiece, the tool is provided with a flange 1A which contacts an inwardly extending lip 37A within to a grip 37 described hereinafter.

The tool sleeve 3, the barrel, the distributor slider body, the air distribution slider and the barrel head comprise the pneumatic motor body. The body of the pneumatic motor is separated from the tool body-casing 4 by means of a vibro-isolating system that consists of a Constant Interaction Force Vibro-isolator and silent block guides as per Polish patent specification No: 121231. The Constant Interaction Force Vibro-isolator is connected to the motor body by a washer 5 made of an elastic material of vibro-isolator characteristics and by sleeves 6. These sleeves 6 together with bolts 7 and washers 8 fasten the vibro-isolator's guide 9 to the barrel head 31. While working, the guide rollers 10 of the vibro-isolator's carriage 11 roll on the guide 9. The carriage acts at the same time as a guide for the vibro-isolator's spring system. The central rollers of carriage 11 roll on cambers of cams 12 that are mounted in shaped grooves 13 in the body-casing 4. The cams 12 are protected from falling out from the grooves 13 by a vibro-isolating spacer 14 that is pressed against the cams by vibro-isolating sleeves 15 and removable fastening 16 and washers 17. The pneumatic motor body is guided in the body-casing 4 by two guides: upper and lower ones that are also the first stage of vibro-isolation between the pneumatic motor body and the operator's hand grips 23 and 37. The upper guide consists of a slide in the form of a sleeve 18 made of a material characterized by a low friction factor and which is mounted in a vibro-isolating sleeve 19 firmly connected to the body-casing 4. The lower guide consists of a sleeve 20 with a multi-slot shaped orifice, the sleeve 20 being connected with an oval sleeve 22 through a layer 21 of a vibro-isolating material. The sleeve 22 is pressed within the body-casing 4. The sleeve 20 fits around the tool sleeve 3.

The air supply system is fitted with a cut-off valve that is connected with a lever located in the operator's right hand grip 23. The lever directly affects a valve head mounted in the operator's right hand grip. A spring pressing the head against the valve seat causes the valve to close. Sealing consists of one gasket made of an elastic material.

Dependent from the grip 23 is mounted also an air feeder pipe 24 that is connected with an air feeder sleeve 38 in the grip 23, the pipe 24 extending into an indirect sleeve 25 that is pressed into the barrel head 31. The indirect sleeve 25 is made of a material characterized by a low friction factor and high vibro-isolation properties. The feeder pipe 24, the lower end of which is blanked off, has two small holes 26 perpendicular to the symmetry axis of the tool. The holes 26 are in line with two openings 29 in the indirect sleeve 25. The indirect air supplying is possible immediately after pressing the grip 23, which makes a hole 27 of bigger diameter, also in the feeder pipe 24 but perpendicular to the holes 26, overlap with two additional holes 29 in the indirect sleeve 25 perpendicular to the holes 26. Additional holes 28 of the feeder pipe 24 are opened in parallel to the holes 26. After the vibro-isolator with constant reaction force deflects so that the holes 28 come in line with the holes 29, the air supplying system becomes entirely opened. Continuing to deflect the vibro-isolator causes the air to be chocked as the holes 28 and 29 become gradually blanked off until being entirely closed. This causes stopping of the impact tool which is a signal for the operator to reduce pressing the grip so that the supply air can freely flow again.

The supply air, after passing through the holes 28 and 29, flows through a chamber 30 between the indirect sleeve 25 and the barrel head 31, which chamber 30 is parallel to the symmetry axis of the tool, and then through air passages 32 in the barrel head to the air distribution slider body.

The air distribution slider controls the air flow and guides it alternately to under or over the ram causing the ram to move to-and-fro. The position of the air distribution slider depends on the position of the ram which causes the hammer tool to start working automatically after switching the air supply on. The air flows from the pneumatic motor and comes to a space between the pneumatic motor body and the body-casing 4. This is a first air decompression chamber. Then, the air flows through openings 35 through the wall of the body-casing 4 into an outflow suppressor mounted on the body-casing 4. The outer wall of the out flow suppressor consists of a conic sleeve 34 made of an elastic light material, through which several outlet holes 36 have been opened. The air is led down from the operator. Thanks to the conic sleeve being rotatable in the body-casings and around the symmetry axis of the hammer tool, the operator may adjust it as he wants.

The chamber within the indirect sleeve 25 between the blanked end of the feeder pipe and the bottom end of the sleeve 25 is additionally decompressed (vented). The purpose of this is the avoidance of pressure shocks (variable uplift pressures) between the body-casing 4 and the pneumatic motor body that would otherwise take place in case of closing of that chamber.

The vibro-isolation of both grips ensures complete vibro-isolation of the hammer tool. The second stage of vibro-isolation of the operator's left hand consists of a sleeve 37 that is made of a material characterized by a high vibration damping coefficient which is screwed onto the body-casing 4. The second stage of vibro-isolation of the operator's right hand consists of the elastic washer 17 and the elastic sleeve 15. Furthermore, the air supply system is also double-isolated. The first stage consists of the indirect sleeve 25 made of a material characterized by a high vibration damping coefficient and mounted on the pneumatic motor body. The second stage consists of the elastic sleeve 38 by means of which the feeder pipe 24 is installed in the operator's right hand grip 23.

The hammer tool is designed in a streamline shape, so its form is esthetic and makes operating with it more easy.

We claim:

1. A pneumatic impact tool comprising a tubular casing having a central elongated axis, a pneumatic engine disposed within said casing, means for admitting compressed air into said engine for operating it, and noise suppression means for exhausting the air from said tool, said noise suppression means comprising a first chamber between said engine and said casing into which spent air from said engine is exhausted, a sleeve mounted on said casing and forming a second chamber therewith, the wall of said casing having holes therethrough providing air flow between said first and said second chambers, the axis of each of said holes being disposed at an acute angle with respect to a plane perpendicular to said central axis, and said sleeve having holes therethrough venting said second chamber to the ambient atmosphere.

2. A tool according to claim 1 wherein said sleeve is rotatably mounted on said housing allowing selective directing of the venting from said sleeve by an operator of said tool.

3. A tool according to claim 1 including a grip disposed at one end of said tool, and a constant interaction force vibroisolator disposed within said casing mechanically interconnecting said engine to said grip, and elastic means for preventing transmission of vibrations from said engine to said grip disposed between the areas of contact of said vibroisolator with each of said grip and said engine.

4. A tool according to claim 3 including bolts for interconnecting said vibroisolator to each of said grip and said engine, and wherein said elastic means include elastic washers and elastic sleeves disposed around shaft portions of said bolts.

5. A tool according to claim 3 wherein said elastic means include annular spacer members disposed between said vibroisolator and each of said grip and said engine.

6. A tool according to claim 3 including elastic sleeves disposed around said engine and interconnecting said engine with the interior wall of said casing.

7. A tool according to claim 3 wherein said air admitting means includes a first tube mounted within said grip and extending into said engine, an elastic material disposed between said first tube and said grip for minimizing transmission of vibrations therebetween, and an air inlet second tube extending from said engine, said first tube extending into said second tube for conveying air thereto and being in sliding fit therewithin for minimizing transmission of vibration from said second tube to said first tube.

8. A tool according to claim 7 wherein the leading end of said first tube within said second tube is closed, thereby creating a chamber within said second tube between said engine and said first tube leading end, said chamber being vented to avoid pressure variations within said chamber upon relative movement of said first tube within said second tube.

9. A tool according to claim 3 wherein said vibroisolator includes an elongated cam and a cam follower, the inside wall of said casing including a groove in which said cam is disposed, and elastic means for securing said cam within said groove.

10. A tool according to claim 3 including a sleeve of elastic material mounted around said casing at the other end of said tool and providing a second grip for said tool.

11. A pneumatic impact machine including a tubular barrel and a working tool extending outwardly therefrom, a ram within said barrel, and means for admitting pressurized air into said barrel for causing reciprocation of said ram within said barrel and directly against an end of said working tool within said barrel, and an annular thrust ring disposed within said barrel and against which said tool end rests as the tool is initially pressed down against an object to be worked by the impact machine said ram being adapted to extend through said thrust ring for direct contact with said tool end.

* * * * *

UNITED STATES PATENT AND TRADEMARK OFFICE

CERTIFICATE OF CORRECTION

PATENT NO. : 5,052,499

DATED : October 1, 1991

INVENTOR(S) : Marian W. Dobry et al

It is certified that error appears in the above-indentified patent and that said Letters Patent is hereby corrected as shown below:

The title page should be deleted to appear as per attached title page.

Fig.1, should be deleted to be replaced with Fig.1 as shown on the attached sheet.

Column 4, lines 25 and 26, "elastic washer 17" should be -- vibro-isolating spacer 14 --.

Column 4,line 26, "elastic sleeve" should be --vibro-isolating --.

Signed and Sealed this

Fourth Day of October, 1994

*Attest:*

*Attesting Officer*

Bruce Lehman

BRUCE LEHMAN

*Commissioner of Patents and Trademarks*

United States Patent [19]

Dobry et al.

[11] Patent Number: 5,052,499

[45] Date of Patent: Oct. 1, 1991

[54] PNEUMATIC IMPACT TOOL

[75] Inventors: Marian W. Dobry; Czesław Cempel; Wieslaw Garbatowski, all of Poznan, Poland

[73] Assignee: Politechnika Pozanska, Poznan, Poland

[21] Appl. No.: 325,302

[22] Filed: Mar. 16, 1989

[30] Foreign Application Priority Data

Mar. 29, 1988 [PL] Poland ..... 271527

[51] Int. Cl.[5] ..... B25D 17/11

[52] U.S. Cl. ..... 173/162.1; 173/139

[58] Field of Search ..... 173/162.1, 162.2, 131, 173/139, 133

[56] References Cited

U.S. PATENT DOCUMENTS

| | | | |
|---|---|---|---|
| 3,640,351 | 2/1972 | Coyne et al. | 173/133 X |
| 4,327,807 | 5/1982 | Emonet | 173/162.1 |
| 4,366,870 | 1/1983 | Frederick | 173/131 |
| 4,402,369 | 9/1983 | Nikita et al. | 173/162.1 |

FOREIGN PATENT DOCUMENTS

| | | |
|---|---|---|
| 115085 | 7/1982 | Poland . |
| 118242 | 4/1983 | Poland . |
| 121231 | 10/1983 | Poland . |
| 122381 | 6/1984 | Poland . |
| 128491 | 8/1985 | Poland . |
| 122477 | 12/1985 | Poland . |

*Primary Examiner*—Joseph M. Gorski
*Assistant Examiner*—Willmon Fridie, Jr.
*Attorney, Agent, or Firm*—Ladas & Parry

[57] ABSTRACT

The pneumatic impact tool is characterized by that the working tool /1/ has a flange that protect the tool from falling out and rests on the thrust ring /2/ mounted in the barrel seat as the hammer tool is being pressed down; moreover one of the noise suppressor chambers that is made up of the conic sleeve /34/ so pushed on the body-casing /4/ as that could rotate round axis, is connected with the second chamber that is made up of the space between the body-casing /4/ and the pneumatic motor's body by means of orifices opened at angle acute to the main axis of the tool symmetry and at tangent to the body plane of the pneumatic motor that is connected with the vibro-isolator of constant reaction force, by means of the vibro-isolating spacers /14/ and temporary fastening /16/, and at the same time the indirect sleeve /25/ mounted between the feeder's pipe /24/ and the barrel head and the elastic layer /38/ act as an additional vibro-isolation between the body-casing /4/ and the grip /23/ and moreover the space before the feeder's pipe /24/ is connected in the indirect sleeve /25/ with the first chamber of the air decompressor by mean of the air passages /32/.

11 Claims, 1 Drawing Sheet

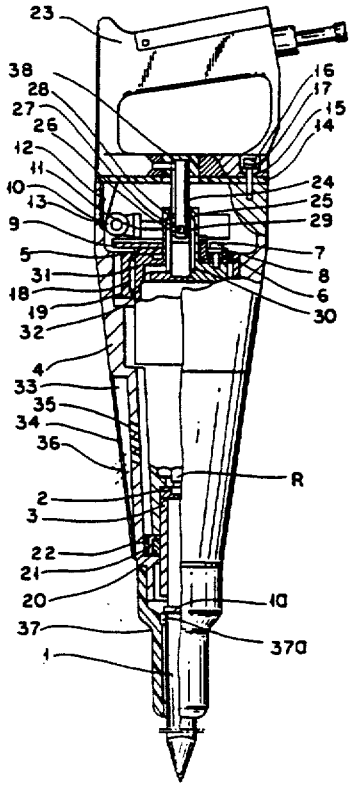

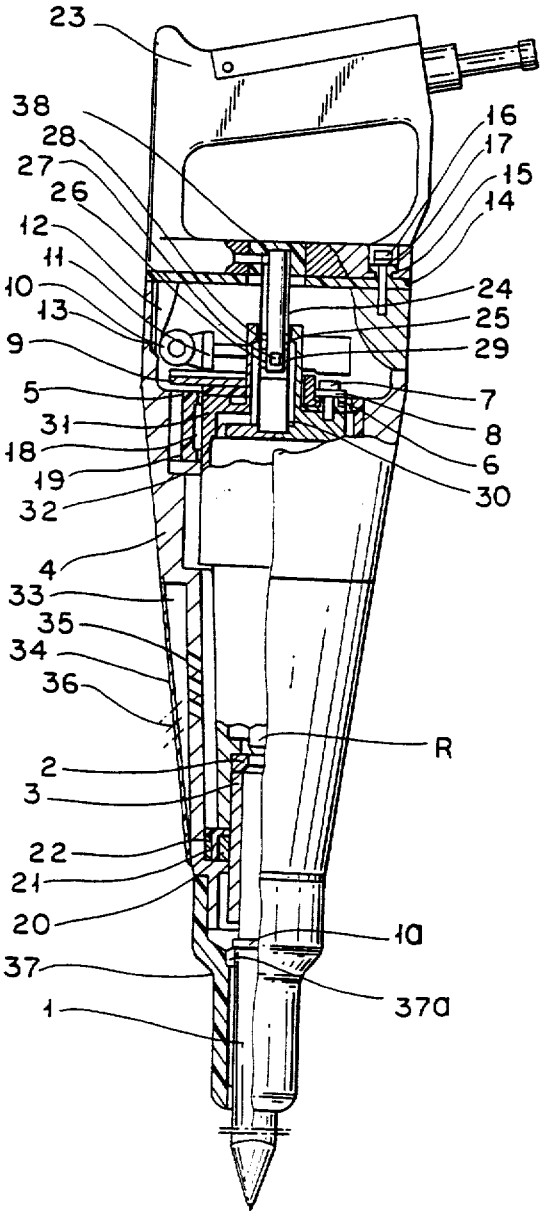
23
38
28
27
26
12
11
10
13
9
5
31
18
19
32
4
33
35
34
36
2
3
22
21
20
37
1
16
17
15
14
24
25
29
7
8
6
30
R
10
37a

UNITED STATES PATENT AND TRADEMARK OFFICE

CERTIFICATE OF CORRECTION

PATENT NO : 5,052,499

DATED : October 1, 1991

INVENTOR(S) :Marian W. Dobry, et. al.

It is certified that error appears in the above-identified patent and that said Letters Patent is hereby corrected as shown below:

The Title page should be deleted to appear as per attached Title page.

Signed and Sealed this

Twenty-second Day of November, 1994

*Attest:*

Bruce Lehman

BRUCE LEHMAN

*Attesting Officer*

*Commissioner of Patents and Trademarks*

United States Patent [19]

Dobry et al.

[11] Patent Number: 5,052,499

[45] Date of Patent: Oct. 1, 1991

[54] PNEUMATIC IMPACT TOOL

[75] Inventors: Marian W. Dobry; Czeslaw Cempel; Wieslaw Garbatowski, all of Poznan, Poland

[73] Assignee: Politechnika Pozanska, Poznan, Poland

[21] Appl. No.: 325,302

[22] Filed: Mar. 16, 1989

[30] Foreign Application Priority Data

Mar. 29, 1988 [PL] Poland ..... 271527

[51] Int. Cl.[5] ..... B25D 17/11

[52] U.S. Cl. ..... 173/162.1; 173/139

[58] Field of Search ..... 173/162.1, 162.2, 131, 173/139, 133

[56] References Cited

U.S. PATENT DOCUMENTS

| | | | |
|---|---|---|---|
| 3,640,351 | 2/1972 | Coyne et al. | 173/133 X |
| 4,327,807 | 5/1982 | Emonet | 173/162.1 |
| 4,366,870 | 1/1983 | Frederick | 173/131 |
| 4,402,369 | 9/1983 | Nikita et al. | 173/162.1 |

FOREIGN PATENT DOCUMENTS

| | | |
|---|---|---|
| 115085 | 7/1982 | Poland . |
| 118242 | 4/1983 | Poland . |
| 121231 | 10/1983 | Poland . |
| 122381 | 6/1984 | Poland . |
| 128491 | 8/1985 | Poland . |
| 122477 | 12/1985 | Poland . |

*Primary Examiner*—Joseph M. Gorski
*Assistant Examiner*—Willmon Fridie, Jr.
*Attorney, Agent, or Firm*—Ladas & Parry

[57] ABSTRACT

The pneumatic impact tool is characterized by that the working tool /1/ has a flange that protect the tool from falling out and rests on the thrust ring /2/ mounted in the barrel seat as the hammer tool is being pressed down; moreover one of the noise suppressor chambers that is made up of the conic sleeve /34/ so pushed on the body-casing /4/ as that could rotate round axis, is connected with the second chamber that is made up of the space between the body-casing /4/ and the pneumatic motor's body by means of orifices opened at angle acute to the main axis of the tool symmetry and at tangent to the body plane of the pneumatic motor that is connected with the vibro-isolator of constant reaction force, by means of the vibro-isolating spacers /14/ and temporary fastening /16/, and at the same time the indirect sleeve /25/ mounted between the feeder's pipe /24/ and the barrel head and the elastic layer /38/ act as an additional vibro-isolation between the body-casing /4/ and the grip /23/ and moreover the space before the feeder's pipe /24/ is connected in the indirect sleeve /25/ with the first chamber of the air decompressor by mean of the air passages /32/.

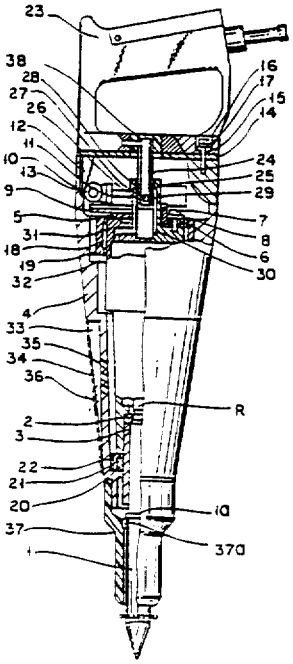

11 Claims, 1 Drawing Sheet